US006889644B2

(12) United States Patent
Ferracin et al.

(10) Patent No.: US 6,889,644 B2
(45) Date of Patent: May 10, 2005

(54) VALVE GUIDE FOR ROCKER ARM ASSEMBLY

(75) Inventors: Sergio Ferracin, Lusiglie (IT); Majo Cecur, Rivarolo Canavese (IT)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 10/884,042

(22) Filed: Jul. 2, 2004

(65) Prior Publication Data

US 2005/0016480 A1 Jan. 27, 2005

(30) Foreign Application Priority Data

Jul. 23, 2003 (EP) ..... 03254593

(51) Int. Cl.[7] ..... F01L 1/18

(52) U.S. Cl. ..... 123/90.39; 123/90.16; 123/90.45; 74/569

(58) Field of Search ..... 123/90.16, 90.27, 123/90.31, 90.39, 90.41, 90.44, 90.45; 74/559, 74/569; 29/888.2

(56) References Cited

U.S. PATENT DOCUMENTS 4,934,323 A * 6/1990 Grinsteiner ..... 123/90.42
5,655,490 A 8/1997 Nagano et al. ..... 123/90.41
6,138,626 A * 10/2000 Speil ..... 123/90.39
6,491,012 B2 * 12/2002 Pryba et al. ..... 123/90.41

* cited by examiner

*Primary Examiner*—Thomas Denion
*Assistant Examiner*—Ching Chang
(74) *Attorney, Agent, or Firm*—L. J. Kasper

(57) ABSTRACT

A rocker arm assembly (55) for a valve control system in an internal combustion engine including a cylinder head (11), and a poppet valve (15). The valve control system comprises an HLA (41) having a ball plunger portion (39). The assembly (55) comprises a rocker arm (57) including axially spaced apart side walls (59,61) and a portion (63) for engagement with the ball plunger (39). The rocker arm assembly (55) further comprises a cam follower (29) disposed about a mounting shaft (31) extending into shaft openings (65) defined by the side walls (59,61), and a pin member (67) defining a valve pad for engagement with a stem tip portion (17), the pin member extending into pin openings (71) defined by the side walls. The assembly (55) includes a clip member (75) including spaced apart clip side walls (77,79) disposed on the outside of the side walls of the rocker arm (57). A connection portion (81) interconnects the clip side walls to restrain axial movement of the mounting shaft (31) and of the pin member (67). The clip side walls (77,79) include retention portions (85,87) engaging the adjacent side walls (59,61) of the rocker arm and extending therebetween and include terminal portions (91) adjacent the pin member (67) to limit rotation of the pin member about its axis, relative to said rocker arm (57).

9 Claims, 5 Drawing Sheets

VALVE GUIDE FOR ROCKER ARM ASSEMBLY

BACKGROUND OF THE DISCLOSURE

The present invention relates to valve control systems for internal combustion engines, and more particularly, to an improved rocker arm assembly for use therein.

Valve control systems for engine poppet valves are generally well known in the art. Although not so limited, the present invention is especially adapted for use in valve control systems of the overhead cam (OHC) type, and will be described in connection therewith. In a typical OHC type of valve control system, there is provided, in addition to the engine poppet valve being controlled, a rocker arm assembly, and some sort of "fulcrum" mechanism about which the rocker arm assembly pivots. In addition, an OHC valve control system includes a camshaft defining a cam profile, and the rocker arm assembly includes a cam follower, such as a roller follower member rotatably disposed about, and supported on a shaft, with the shaft being fixed relative to the rocker arm assembly.

Typically, such rocker arm assemblies, of the type to which the present invention relates, include an integrally-formed valve tip pad portion to engage the upper stem tip portion of the engine poppet valve. The recent trend has been away from such integral valve tip pad portions, and toward the use of rotatable (pivotable) pad portions which can engage the stem tip, without sliding engagement therebetween. For example, U.S. Pat. No. 5,655,490 illustrates a number of different configuration types and mounting arrangements for stem tip pad portions. Among the various pad portion configurations shown in the cited patent are several which are of the "notched-log" type, i.e., they are generally cylindrical in overall configuration, but toward the center, are notched to define one or more flat surfaces, one of which is especially adapted for engaging the end surface of the stem tip portion. Thus, although the present invention is not limited to this particular configuration of stem tip pad portion, or to any other particular configuration, except as is noted in the appended claims, the "notched-log" configuration does represent one preferred embodiment, and the invention will be described in connection therewith.

Although many valve control systems for internal combustion engine poppet valves are of the conventional, fixed type (i.e., having no capability of varying the valve lift or "deactivating" the engine poppet valve), and the invention may be used advantageously in such "fixed" valve control systems, the invention is especially adapted for use in deactivating valve control systems, and will be described in connection therewith. Although the various structures utilized to achieve valve deactivation are not essential to, and not even especially relevant to the present invention, and therefore will be described only briefly herein, there is one aspect of the typical valve deactivation system which is relevant to the present invention. Whereas, in a typical "fixed" valve control system, the rocker arm might pivot through an angle of only about 10 to 20 degrees, in a typical valve deactivating system, the rocker arm assembly typically pivots through an angle of as much as 25 degrees.

The need to maintain non-sliding engagement between the end surface of the valve stem tip portion and the rocker arm pad portion, through a relatively greater range of pivoting motion of the rocker arm (in the case of valve deactivation), somewhat complicates the provision of an appropriate valve tip pad portion, and the mounting of, and retention of the pad portion within the rocker arm assembly.

As is well known to those skilled in the art, the provision of a rotatable (or pivotable) pad portion which must be retained within the rocker arm assembly, in addition to the presence of the cam follower which is mounted on a shaft, and which must also be retained relative to the rocker arm assembly, adds substantially to the number of parts included in the overall rocker arm assembly. The necessary retention of the pad portion and the cam follower shaft also add substantially to the overall manufacturing expense of the rocker arm assembly, and especially, the time and expense of assembling the rocker arm.

BRIEF SUMMARY OF THE INVENTION

Accordingly, it is an object of the present invention to provide an improved rocker arm assembly which overcomes the disadvantages of the prior art, as discussed above.

It is a further object of the present invention to provide such an improved rocker arm assembly having an improved valve stem tip pad portion, and retention arrangement therefor.

It is another object of the present invention to provide an improved rocker arm assembly which achieves the above-stated objects while minimizing the number of parts in the rocker arm assembly, and reducing the assembly time and cost thereof.

The above and other objects of the invention are accomplished by the provision of a rocker arm assembly for use in a valve control system for an internal combustion engine including a cylinder head, and a poppet valve moveable relative to the cylinder head between open and closed positions in response to rotation of a camshaft defining a cam profile. The valve control system further comprises a fulcrum device being substantially fixed relative to the cylinder head and including a fulcrum portion. The rocker arm assembly comprises a rocker arm including a pair of axially spaced apart side walls interconnected by a portion defining a fulcrum surface for engagement with the fulcrum portion, whereby the rocker arm assembly pivots about the fulcrum portion as the poppet valve moves between the open and closed positions. The rocker arm assembly further comprises a cam follower disposed between the side walls for engagement with the cam profile, and disposed about a mounting shaft extending into shaft openings defined by the side walls of the rocker arm. The rocker arm assembly also comprises a pin member defining a valve pad for engagement with a stem tip portion of the poppet valve, the pin member extending into pin openings defined by the side walls of the rocker arm. Finally, the rocker arm assembly also includes a clip member.

The improved rocker arm assembly is characterized by the clip member including a pair of axially spaced apart clip side walls disposed adjacent, and on the outside of, the side walls of the rocker arm, and a connection portion interconnecting the clip side walls. The clip side walls are disposed to restrain axial movement, in either direction, of the mounting shaft and of the pin member. One of the clip side walls includes a first retention portion engaging the adjacent side wall of the rocker arm and extending between the side walls of the rocker arm, and including a terminal portion disposed adjacent the pin member, and operable to limit rotation of the pin member about its axis, relative to the rocker arm.

DETAILED DESCRIPTION OF THE PREFERRED EMBODIMENT

Figure 1:
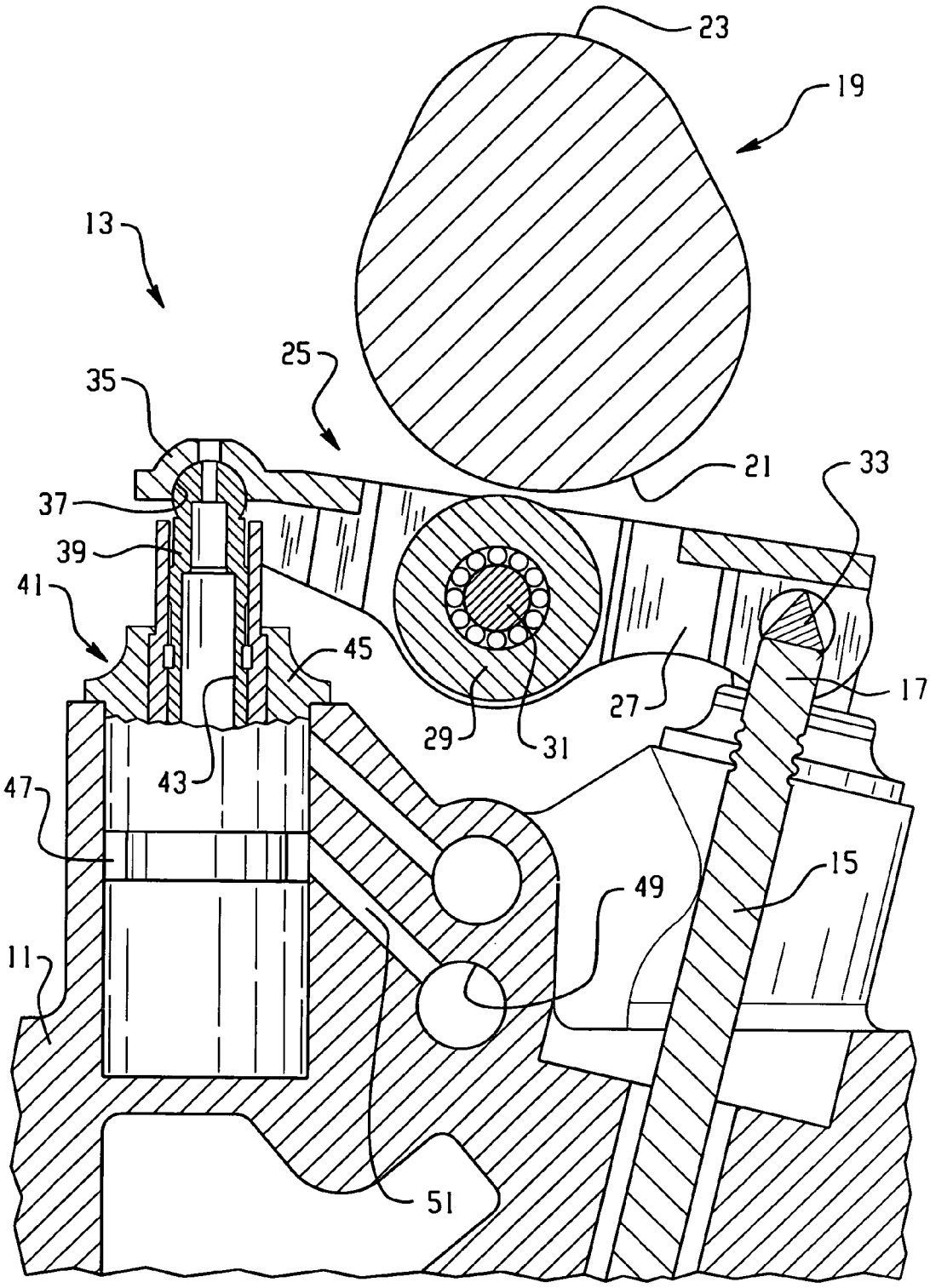
Fig. 1 PRIOR ART
FIG. 1 is a fragmentary view, mostly in transverse cross-section, of a valve control system, made in accordance with the "Prior Art", of the type with which the present invention may be utilized.

Referring now to the drawings, which are not intended to limit the invention, FIG. 1 illustrates a portion of a cylinder head 11 of an internal combustion engine of the overhead cam (OHC) type, with which the rocker arm assembly of the present invention may be utilized. In FIG. 1, there is a conventional ("Prior Art") valve control system, generally designated 13, which is utilized to control the movement ("lift") of an engine poppet valve 15. The engine poppet valve 15 includes a tip portion 17 (also referred to herein as a "stem tip portion"). As is well known to those skilled in the art, the tip portion 17 is typically surrounded by a spring retainer (not show herein) which serves as the seat for the upper end of a valve return spring (also not shown herein for simplicity).

The valve control system 13 operates in conjunction with a camshaft, generally designated 19, to provide cyclical opening motion to the engine poppet valve 15, in opposition to the biasing (closing) force of the valve return spring. The camshaft 19 includes a base circle portion 21, and a valve lift portion 23, as is well known to those skilled in the art.

The conventional valve control system 13, as shown in the "Prior Art" version in FIG. 1, includes a rocker arm assembly, generally designated 25, including a fairly conventional, typically stamped rocker arm 27. In the subject embodiment of both the Prior Art and the invention, and by way of example only, the rocker arm 27 comprises a downwardly-opening, generally U-shaped member. The rocker arm assembly 25 supports, for relative rotation therein, a cam follower (roller) 29, which is rotatably mounted about a shaft 31.

The right end of the rocker arm assembly 25 (as viewed in FIG. 1) includes a triangular stem tip pad portion (hereinafter simply referred to as a pad portion), designated 33, which is now known in the art, and which engages the end surface of the stem tip portion 17 of the poppet valve 15. At the opposite axial end of the rocker arm assembly 25, the rocker arm 27 defines a partly-spherical (or "domed") portion 35, the underside of which comprises a fulcrum surface 37, disposed for engagement with a ball plunger portion 39 of a hydraulic lash adjuster (HLA), generally designated 41. As is well known to those skilled in the art of OHC valve gear train, there is typically a "fulcrum portion" provided, about which the rocker arm assembly pivots. In the subject embodiment, and by way of example only, the HLA 41 comprises the "fulcrum portion", it being understood that various other structures could, within the scope of the present invention, be included to provide the needed fulcrum portion (or pivot point).

In the subject embodiment, and also by way of example only, the HLA 41 is a deactivating type of lash adjuster, in which an inner body member 43 can be in either a latched condition, or an unlatched condition, relative to an outer body member 45, as is now well known to those skilled in the "valve deactivation" art. As is also well known to those skilled in the art, the unlatched condition of the inner body member 43 would typically occur in response to the presence of pressurized fluid in an annular groove 47 defined by the outer body member 45. The pressurized control fluid in the annular groove 47 would be communicated from a source, generally designated 49, of control pressure provided from a remote location within the cylinder head 11. The control pressure would then be communicated from the source 49 through a fluid passage 51 to the annular groove 47, to achieve the unlatched condition. However, it should be understood that, for purposes of the present invention, neither the details of the deactivating HLA 41, nor even the presence of a deactivating HLA, are essential features.

Figure 2:
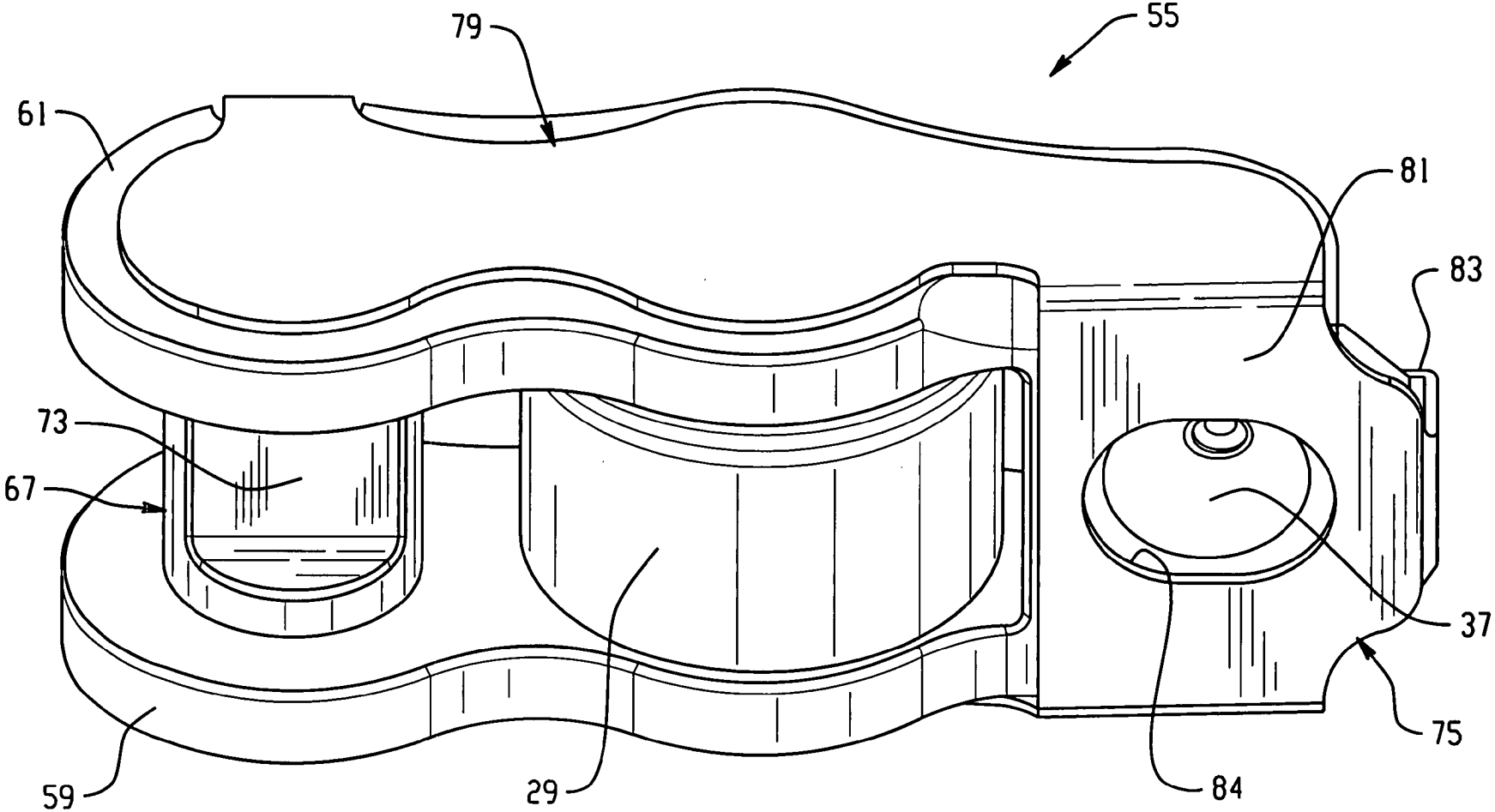
FIG. 2 is a top perspective view of the rocker arm assembly of the present invention, on a scale somewhat larger than FIG. 1.
Figure 3:
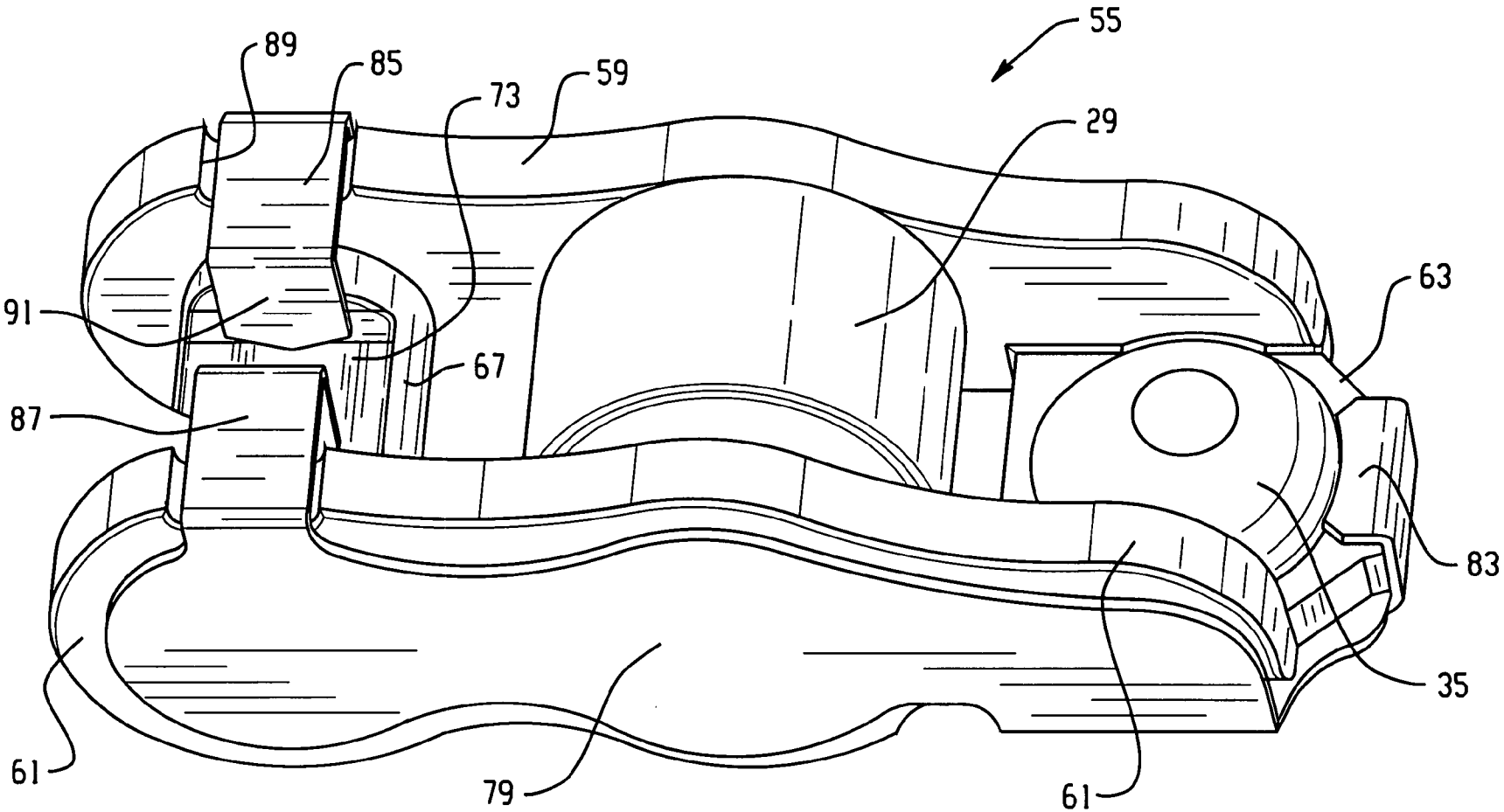
FIG. 3 is a perspective view of the rocker arm assembly shown in FIG. 2, but viewed from the bottom, and on substantially the same scale as FIG. 2.

Referring now primarily to FIGS. 2 and 3, there will be a description of the rocker arm assembly of the present invention, which is generally designated 55. It should be understood that the rocker arm assembly 55 would, in carrying out the present invention, be utilized in place of the Prior Art rocker arm assembly 25, in the valve control system of FIG. 1. In the subsequent description, certain elements which are the same or substantially the same as in the Prior Art rocker arm assembly 25 of FIG. 1 will bear the same reference numerals. The rocker arm assembly 55 includes a rocker arm 57 which preferably comprises an integral, one-piece, stamped member, typically for economic reasons. The rocker arm 57 includes a pair of side walls 59 and 61 which are interconnected by a connection portion 63 (best seen in FIG. 3) which includes the domed portion 35, which, in turn, defines on its underside the fulcrum surface 37 (see FIG. 2). As noted earlier, the fulcrum surface 37 engages the ball plunger portion 39 of the HLA 41.

Figure 4:
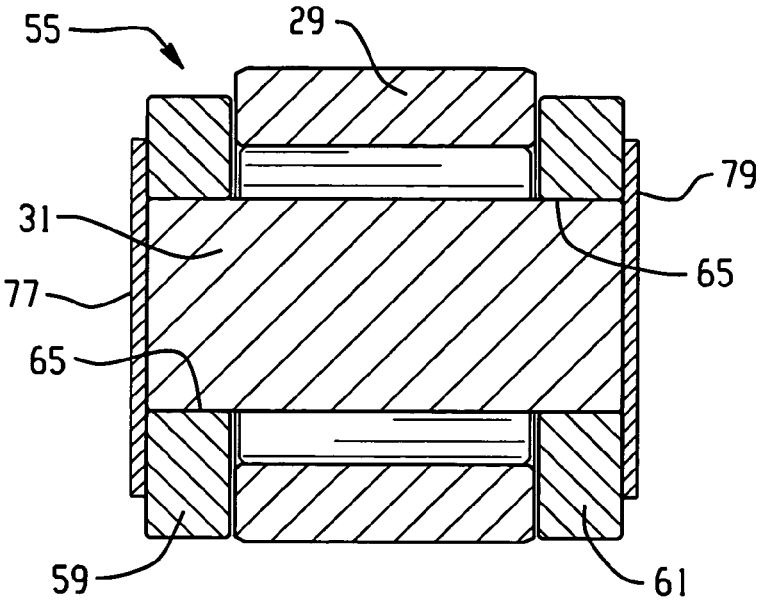
FIG. 4 is a transverse cross-section through the rocker arm assembly of the present invention, illustrating the mounting of the cam follower.

As may best be seen in FIG. 4, the side walls 59 and 61 define circular shaft openings 65, which receive and support the opposite ends of the shaft 31 upon which is rotatably mounted the cam follower 29. In the subject embodiment of the invention, the axial length of the shaft 31 is approximately equal to the axial distance from the outer surface of the side wall 59 to outer surface of the side wall 61, for reasons which will become apparent subsequently. In many prior art rocker arm assemblies, the axial length of the follower shaft would be longer, typically being long enough to accommodate a retention member (such as a "C" clip) on each end of the follower shaft. In turn, such an arrangement would require that the follower shaft be machined to include an appropriate groove at each end of the shaft, adding further expense to the rocker arm assembly. The present invention substantially eliminates the extra machining and assembly processes noted above.

Figure 5:
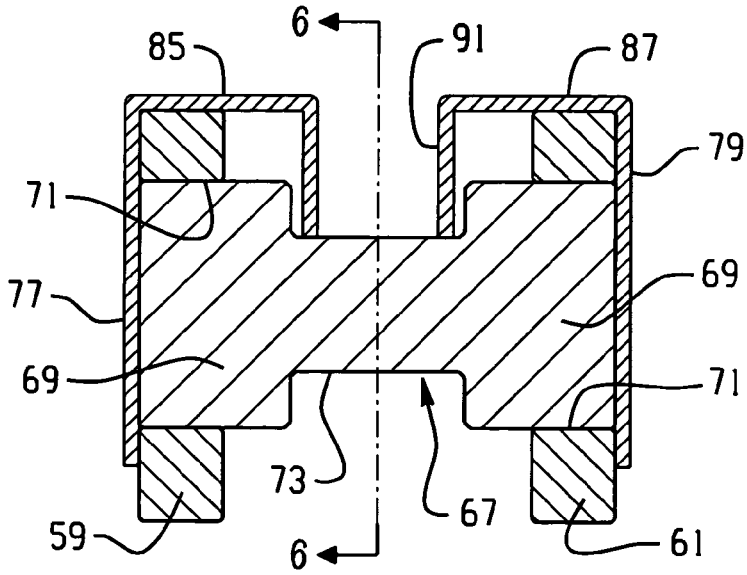
FIG. 5 is a transverse cross-section, similar to FIG. 4, and on the same scale, but taken through the valve tip pad portion.

Referring now primarily to FIGS. 2 and 5, what will be described next is a valve stem tip pad portion, in accordance with the present invention, to be utilized in place of the pad portion 33 in the Prior Art device of FIG. 1. The rocker arm assembly 55 of the present invention includes a pin member 67 which, as is best be shown in FIGS. 5 and 6, includes a pair of oppositely disposed cylindrical end portions 69, each of which is rotatably disposed within a circular pin opening 71, defined by the side walls 59 and 61. The pin member 67 has the generally "notched-log" configuration, as was mentioned in the Background Of The Disclosure, and therefore, defines a pair of parallel, flat pad surfaces 73 (each of which is capable of comprising a "pad portion" for engagement with the valve stem tip portion 17. Therefore, the pin member 67 is "reversible", i.e., it can be installed in the position shown in FIGS. 2, 3, 5, and 6, or it may be rotated 180 degrees, and those skilled in the art will understand that the pin member 67 will function identically, in either of those diametrically opposite positions. Furthermore, although the present invention is being described in connection with an embodiment in which the pin member 67 has a pair of parallel pad surfaces 73, it should be understood that the invention is not so limited. If desirable, and by way of example only, the pin member 67 could include only a single pad surface 73, or alternatively, could include three of the pad surfaces 73, arranged similar to what is shown for the pad portion 33 in FIG. 1, or any other number of pad portions 73, as desired.

As was described in regard to the shaft 31, it is preferred, but not essential, that the pin member 67 have an axial length which is approximately equal to the distance from the outer surface of the side wall 59 to the outer surface of the side wall 61, as may best be seen in FIGS. 4 and 5, for reasons which also will be described subsequently. Again, in some of the known, prior art devices, the pin member (or pad portion) would extend far enough beyond the wall surfaces of the rocker arm side walls to permit the use of some sort of retention member (such as a "C" clip) on each axial end thereof. Again, the present invention substantially eliminates the need for such additional parts and assembly of the type noted above.

In accordance with an important aspect of the invention, the rocker arm assembly 55 includes a clip member 75 and, as may best be seen in FIG. 7, the clip member 75 preferably comprises a stamped member which is subsequently formed into the shape shown in FIGS. 2–6. The clip member 75 includes a pair of clip side walls 77 and 79 which, in the subject embodiment, are disposed immediately adjacent the outer surfaces of the rocker arm side walls 59 and 61, respectively. It should be understood by those skilled in the art that in FIGS. 4 and 5, the clip side walls 77 and 79 are shown, primarily for ease of illustration, as being disposed in engagement with the outer surfaces of the side walls 59 and 61. However, within the scope of the invention, the clip side walls 77 and 79 could also be disposed slightly spaced apart from the outer surfaces of the side walls 59 and 61, respectively.

Figure 7:
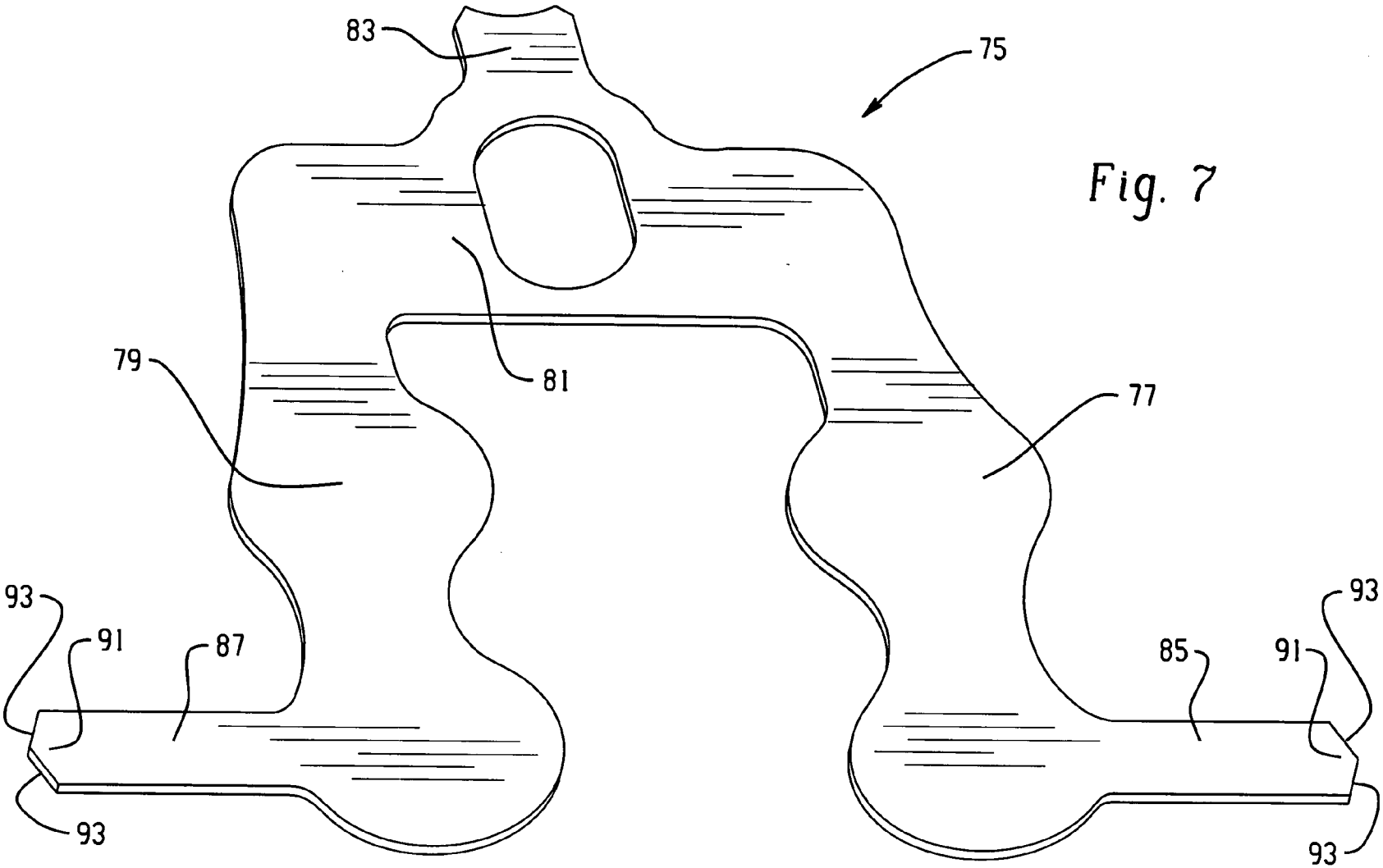
FIG. 7 is a flat, plan view of the clip member of the present invention, prior to it being formed into its final shape.

The clip side walls 77 and 79 are joined by a connection portion 81, shown fully only in FIGS. 2 and 7, the connection portion 81 including a retention tab 83 which is bent into a generally U-shaped configuration (see also FIG. 3), tightly engaging the connection portion 63 of the rocker arm 57. It will be understood from the subsequent description of the clip member 75, that the retention tab 83 is part of the structure responsible for retaining the clip member 75 in place, relative to the rocker arm 57. The rest of the structure which serves the retention function will be mentioned subsequently. The connection portion 81 defines a slot 84 which is sized such that the connection portion 81 slips over the ball plunger portion 39, slightly deforming the sides of the slot 84 until the sides of the slot engage an undercut on the ball plunger portion 39. Thereafter, the ball plunger portion 39 and the rocker arm assembly 55 remain in the above-described "assembled" position, relative to each other, in preparation for subsequent assembly of the valve control system into the cylinder head 11.

Referring now primarily to FIGS. 3 and 5, the clip side walls 77 and 79 include, at the axial end opposite the retention tab 83, retention and orientation portions 85 and 87, respectively. Although not essential to the present invention, the retention and orientation portions 85 and 87 are substantially identical to each other. In some applications for the rocker arm assembly 55, it may be sufficient to provide only one of the retention and orientation portions (85 or 87), but in the subject embodiment, both are provided, although only the portion 85 will be described hereinafter, it being understood that the description would apply equally to the portion 87.

Figure 6:
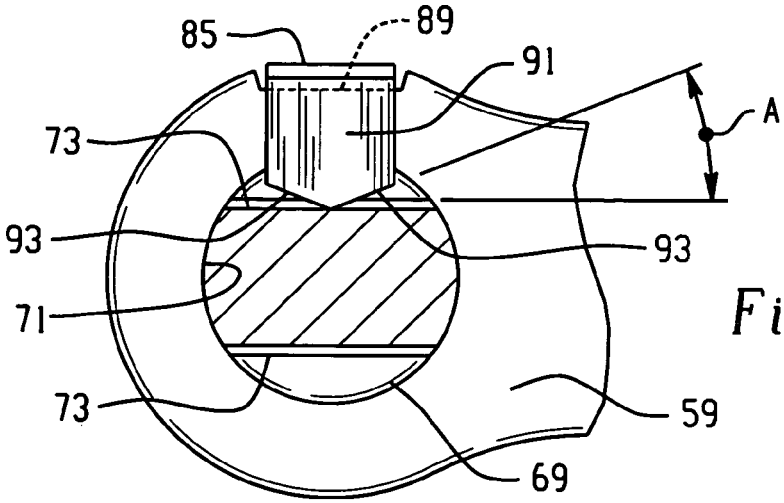
FIG. 6 is a fragmentary, axial cross-section, taken on line 6—6 of FIG. 5, and on approximately the same scale.

As may best be seen in FIGS. 3, 5 and 6, the retention and orientation portion 85 is received within a shallow notch 89 (see FIGS. 3 and 6) formed in the upper surface of the rocker arm side wall 59. It is this engagement of the portion 85 within the notch 89 that completes the function of retention of the clip member 75 relative to the rocker arm 57. The retention and orientation portion 85 extends "inward" (i.e., toward the opposite side wall 61 in FIG. 5) and includes a terminal portion 91 which extends towards the pad surface 73 disposed toward the "top" of the pin member 67, i.e., not the pad surface 73 which will engage the valve stem tip portion 17.

In accordance one important aspect of the invention, the clip side walls 77 and 79 are preferably disposed adjacent, and on the outside of, the rocker arm side walls 59 and 61, respectively, as shown in FIGS. 4 and 5. The location of the clip side walls 77 and 79 inherently serves to restrain any axial movement of the follower shaft 31, and of the pin member 67, without the need for any other form of retention means, and just as importantly, without the need for any special assembly steps, such as the installation of "C" clips on the shaft and member. Thus, the simple, stamped clip member 75 replaces whatever structure and assembly time was previously required, in the prior art devices, to retain the follower shaft 31 and the pad portion. It should be understood that, although (see FIG. 7) the clip side walls 77 and 79 are shown herein as "full" walls, such is not essential to the present invention. If so desired the clip side walls 77 and 79 could include open portions over some, or even a major portion of the area of the side walls 77 and 79 in the drawings. All that is essential to the invention is that the side walls 77 and 79 include enough of a "wall" to connect the connection portion 81 to the retention portions 85 and 87, and enough of a "wall" to restrain (and retain) the shaft 31 and the pin member 67.

In accordance with another important aspect of the invention, and as is best seen in FIG. 6, the terminal portion 91 extends to a location adjacent the "top" pad surface 73 (i.e., the pad surface 73 opposite the one which will engage the valve stem tip portion 17). The terminal portion 91 includes a pair of orientation surfaces 93, each of which is disposed at an angle "A" relative to a horizontal plane, and relative to the adjacent pad surface 73. Preferably, the angle "A" is approximately equal to (or maybe slightly greater than) the maximum angle of pivotal movement of the rocker arm assembly 55, during its normal operation. As is well known to those skilled in the art, the rocker arm assembly 55 typically undergoes a greater angle of movement when operating in the unlatched (deactivated) condition, and therefore, the angle "A" should be selected to correspond to the angle of pivotal movement when the rocker arm assembly is deactivated.

When the rocker arm assembly 55 is assembled, and the clip member 75 is installed about the rocker arm 57, the orientation surfaces 93, disposed adjacent the pad surface 73, will limit rotation of the pin member 67, relative to the rocker arm assembly 55, to movement through the angle "A". As a result, the pin member 67 is always within the angle "A" of "proper orientation" at the time the rocker arm assembly 55 is installed onto the cylinder head 11. By "proper orientation" it is meant that the pin member 67 is oriented at an angle such that, when the pad surface 73 engages the valve stem tip portion 17, the engaging surfaces will be nearly enough parallel that the engagement will cause the pin member 67 to rotate slightly until the pad surface 73 and the end surface of the tip portion 17 are in parallel, face-to-face engagement. Thus, at the time of the assembly of the rocker arm assembly 55 to the cylinder head, it is not necessary to engage is any separate step of orienting the pin member 67 to achieve the proper engagement of the pad surface 73 to the end surface of the tip portion 17, such engagement just inherently occurs as a result of the present invention.

The invention has been described in great detail in the foregoing specification, and it is believed that various alterations and modifications of the invention will become apparent to those skilled in the art from a reading and understanding of the specification. It is intended that all such alterations and modifications are included in the invention, insofar as they come within the scope of the appended claims.

What is claimed is:

1. A rocker arm assembly for use in a valve control system for an internal combustion engine including a cylinder head, and a poppet valve moveable relative to said cylinder head between open and closed positions in response to rotation of a camshaft defining a cam profile; said valve control system further comprising a fulcrum device being substantially fixed relative to said cylinder head and including a fulcrum portion; said rocker arm assembly comprising a rocker arm including a pair of axially spaced apart side walls interconnected by a portion defining a fulcrum surface for engagement with said fulcrum portion, whereby said rocker arm assembly pivots about said fulcrum portion as said poppet valve moves between said open and closed positions; said rocker arm assembly further comprising a cam follower disposed between said side walls for engagement with said cam profile, and disposed about a mounting shaft extending into shaft openings defined by said side walls, and a pin member defining a valve pad for engagement with a stem tip portion of said poppet valve, said pin member extending into pin openings defined by said side walls; said rocker arm assembly including a clip member; said rocker arm assembly being characterized by:

(a) said clip member including a pair of axially spaced apart clip side walls disposed adjacent, and on the outside of, said side walls of said rocker arm, and a connection portion interconnecting said clip side walls;

(b) said clip side walls being disposed to restrain axial movement, in either axial direction, of said mounting shaft and of said pin member; and (c) one of said clip side walls including a first retention portion engaging the adjacent side wall of said rocker arm and extending between said side walls of said rocker arm and including a terminal portion disposed adjacent said pin member and operable to limit rotation of said pin member about its axis, relative to said rocker arm.

2. A rocker arm assembly as claimed in claim 1, characterized by said clip member including a second retention portion disposed at a generally opposite axial end of said clip member from said first retention portion, said second retention portion engaging said connection portion of said rocker arm.

3. A rocker arm assembly as claimed in claim 1, characterized by said fulcrum device comprises a hydraulic lash compensation device, and said fulcrum portion comprises a moveable plunger element of the type which is moveable to compensate for lash in said valve control system.

4. A rocker arm assembly as claimed in claim 3, characterized by said connection portion defines an opening sized to fit over said plunger element, but to remain in engagement therewith during a subsequent assembly operation of said rocker arm assembly into said cylinder head.

5. A rocker arm assembly as claimed in claim 1, characterized by said pin member having a generally cylindrical overall configuration, and said pin openings being circular and receiving end portions of said pin member in said pin openings, whereby said pin member is free to rotate within said pin openings.

6. A rocker arm assembly as claimed in claim 1, characterized by said clip member comprising a single, integrally formed member, formed from an initially-flat sheet-like member, and formed to have said clip side walls axially spaced apart and generally parallel to each other.

7. A rocker arm assembly as claimed in claim 1, characterized by said clip side walls each including one of said first retention portions, whereby said first retention portions both extend from said clip side walls toward each other, and then both terminate between said side walls of said rocker arm.

8. A rocker arm assembly as claimed in claim 7, characterized by each of said first retention portions engage the respective, adjacent side wall of said rocker arm and includes a terminal portion disposed adjacent said pin member and is operable to limit rotation of said pin member about its axis, relative to said rocker arm.

9. A rocker arm assembly as claimed in claim 1, characterized by each of said mounting shaft and said pin member have an axial length substantially equal to the axial distance from the outer surface of said side wall of said rocker arm to the outer surface of said side wall of said rocker arm.

* * * * *